US009908355B1

(12) United States Patent
Choueifati

(10) Patent No.: US 9,908,355 B1
(45) Date of Patent: Mar. 6, 2018

(54) PROCESS FOR MARKING A WALL

(71) Applicant: Antoine Choueifati, Houston, TX (US)

(72) Inventor: Antoine Choueifati, Houston, TX (US)

( * ) Notice: Subject to any disclaimer, the term of this patent is extended or adjusted under 35 U.S.C. 154(b) by 120 days.

(21) Appl. No.: 15/204,724

(22) Filed: Jul. 7, 2016

Related U.S. Application Data

(60) Provisional application No. 62/189,255, filed on Jul. 7, 2015.

(51) Int. Cl.
*B25H 7/00* (2006.01)
*B41K 1/00* (2006.01)

(52) U.S. Cl.
CPC ..... *B41K 1/003* (2013.01)

(58) Field of Classification Search
CPC ..... B41K 1/003
USPC ..... 33/574, 578, 613, 645, 666, 669
See application file for complete search history.

(56) References Cited

U.S. PATENT DOCUMENTS 4,382,337 A * 5/1983 Bendick ..... B25H 7/04 33/574
5,867,917 A * 2/1999 Karon ..... A47G 1/205 33/613
2002/0066200 A1* 6/2002 Lombardo ..... A47G 1/205 33/666
2007/0283588 A1* 12/2007 Gardner ..... F16B 15/02 33/666
2009/0165319 A1* 7/2009 Gallien ..... A47G 1/205 33/666
2010/0116964 A1* 5/2010 Aleo ..... A47G 1/202 248/476
2011/0023313 A1* 2/2011 Johnson ..... B25H 7/04 33/666
2012/0246957 A1* 10/2012 Daniel ..... A47G 1/205 33/645
2015/0352456 A1* 12/2015 Barkouras ..... A63H 33/00 434/81
2016/0128497 A1* 5/2016 Marks ..... A47G 1/24 33/666

* cited by examiner

*Primary Examiner* — G. Bradley Bennett
(74) *Attorney, Agent, or Firm* — Plager Schack LLP

(57) ABSTRACT

A process for marking a wall in order to hang a frame on the wall includes the following steps. First, obtaining a frame further comprising a first hanger position, a second hanger position, and a third hanger position. Then, applying an ink onto a sponge proximate the frame. After that, applying a first inked sponge over the first hanger position. Following that, applying a second inked sponge over the second hanger position. Then, applying a third inked sponge over the third hanger position. Next, pressing the frame into the wall. Finally, removing the frame from the wall revealing a first nail marker, s second nail marker and a third nail marker.

4 Claims, 5 Drawing Sheets

PROCESS FOR MARKING A WALL

RELATED APPLICATION

This application claims priority to provisional patent application U.S. Ser. No. 62/189,255 filed on Jul. 7, 2015, the entire contents of which is herein incorporated by reference.

BACKGROUND

The embodiments herein relate generally to systems for hanging frames from a wall.

Prior to embodiments of the disclosed invention, there was no simple and accurate way to mark a wall prior to hanging a frame. Embodiments of the disclosed invention solve this problem.

SUMMARY

A process for marking a wall in order to hang a frame on the wall includes the following steps. First, obtaining a frame further comprising a first hanger position, a second hanger position, and a third hanger position. Then, applying an ink onto a sponge proximate the frame. After that, applying a first inked sponge over the first hanger position. Following that, applying a second inked sponge over the second hanger position. Then, applying a third inked sponge over the third hanger position. Next, pressing the frame into the wall. Finally, removing the frame from the wall revealing a first nail marker, s second nail marker and a third nail marker.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
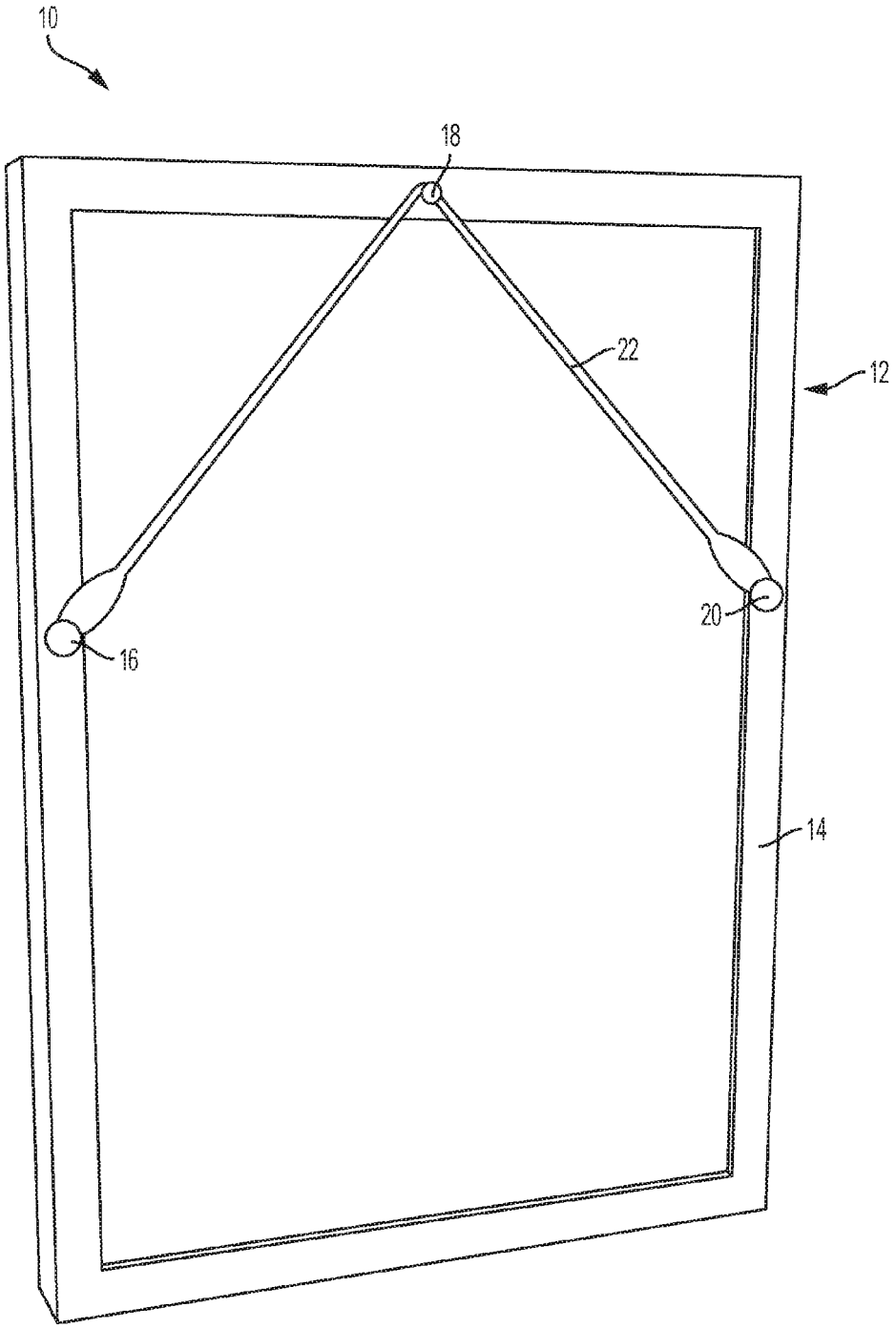
FIG. 1 shows a perspective view of one embodiment of the present invention.

By way of example, and referring to FIG. 1, process for hanging a frame 10 involves the following steps, which are not necessarily in order. First, at step 12, obtaining a frame 14 further comprising a first hanger position 16, a second hanger position 18 and a third hanger position 20. Wire assembly 22 is connected to first hanger position 16 and third hanger position 20 while being wrapped around second hanger position 18.

Figure 2:
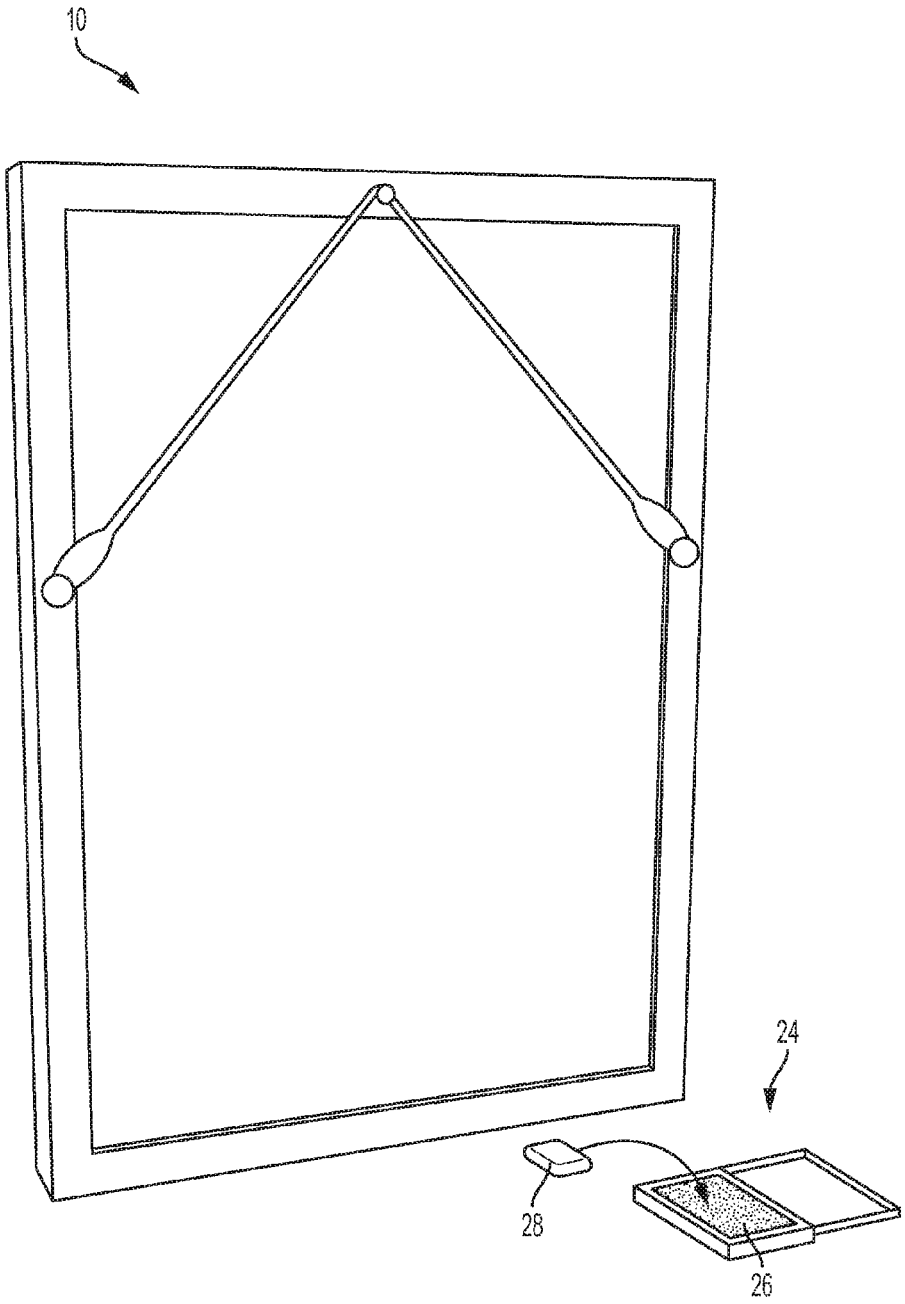
FIG. 2 shows a perspective view of one embodiment of the present invention.

Turning to FIG. 2, at step 24, applying an ink 26 onto a sponge 28. The ink and sponge combination can be 60% sponge by weight and 40% ink by weight. The sponge 28 comprises a latex made of styrene and butadiene obtained from petroleum. The ink 26 further comprises water which is about 5% of the ink 26 by weight and can be that identified by CAS RN 7732-18-5. Ink 26 further comprises Polysorbate 80 which is about 75% of the ink 26 by weight and can be that identified by CAS RN 9005-65-6 and is sometimes called Polyoxyethylenesorbitan monooleate, TWEEN® 80. Ink 26 further comprises Antioxidant 1076 which is about 5% of the ink 26 by weight and can be identified by CAS RN 2082-79-3 and is sometimes called Octadecyl 3-(3,5-di-tert-butyl-4-hydroxyphenyl)propionate. Ink 26 further comprises Pigment Red 112 which is about 15% of ink 26 by weight and can be identified by CAS RN 6535-46-2 and is sometimes called 2-Naphthalenecarboxamide, 3-hydroxy-N-(2-methylphenyl)-4-[(2,4,5-trichlorophenyl) azo].

Figure 3:
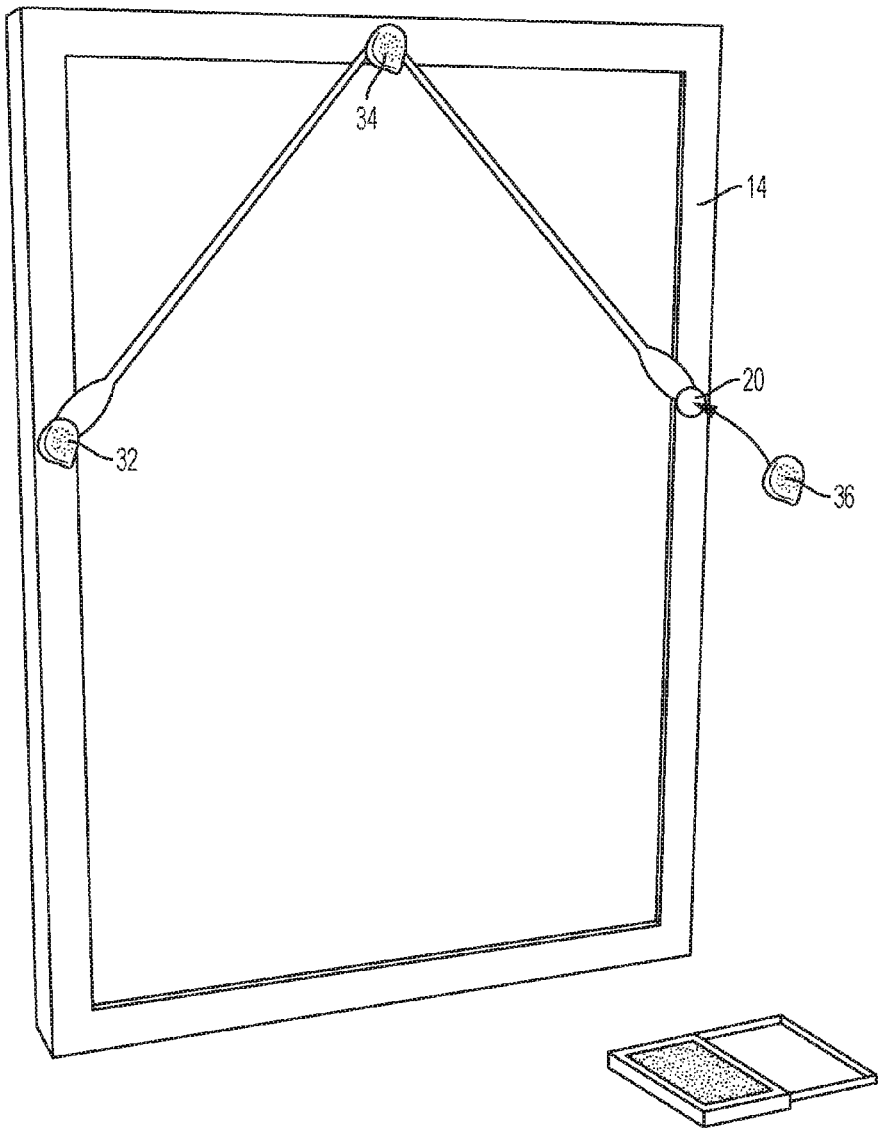
FIG. 3 shows a perspective view of one embodiment of the present invention.

Turning to FIG. 3, at step 30, pieces of the inked sponge are torn and applied to frame 14. A first inked sponge 32 is applied over the first hanger position 16. A second inked sponge 34 is applied over the second hanger position 18. A third inked sponge 36 is applied over the third hanger position 20.

Figure 4:
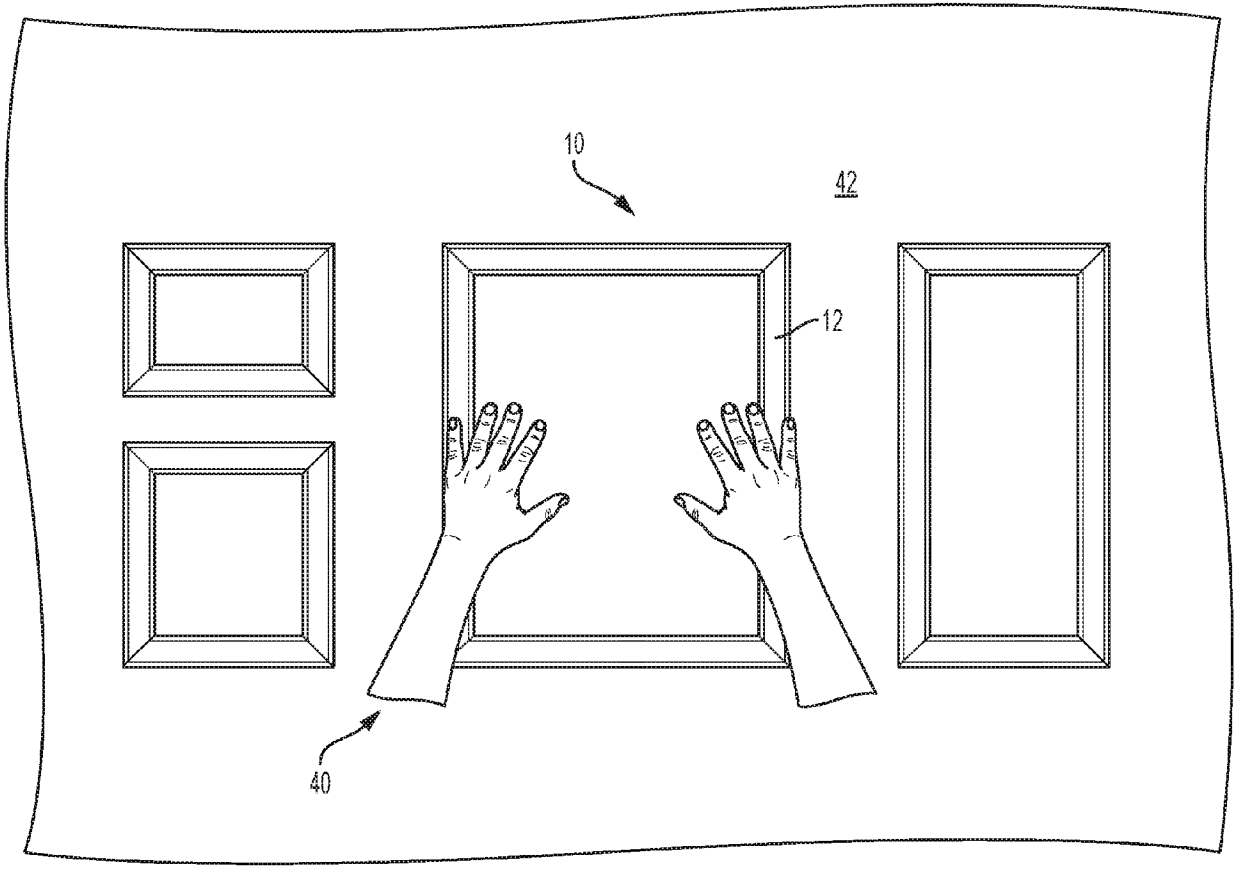
FIG. 4 shows a perspective view of one embodiment of the present invention.
Figure 5:
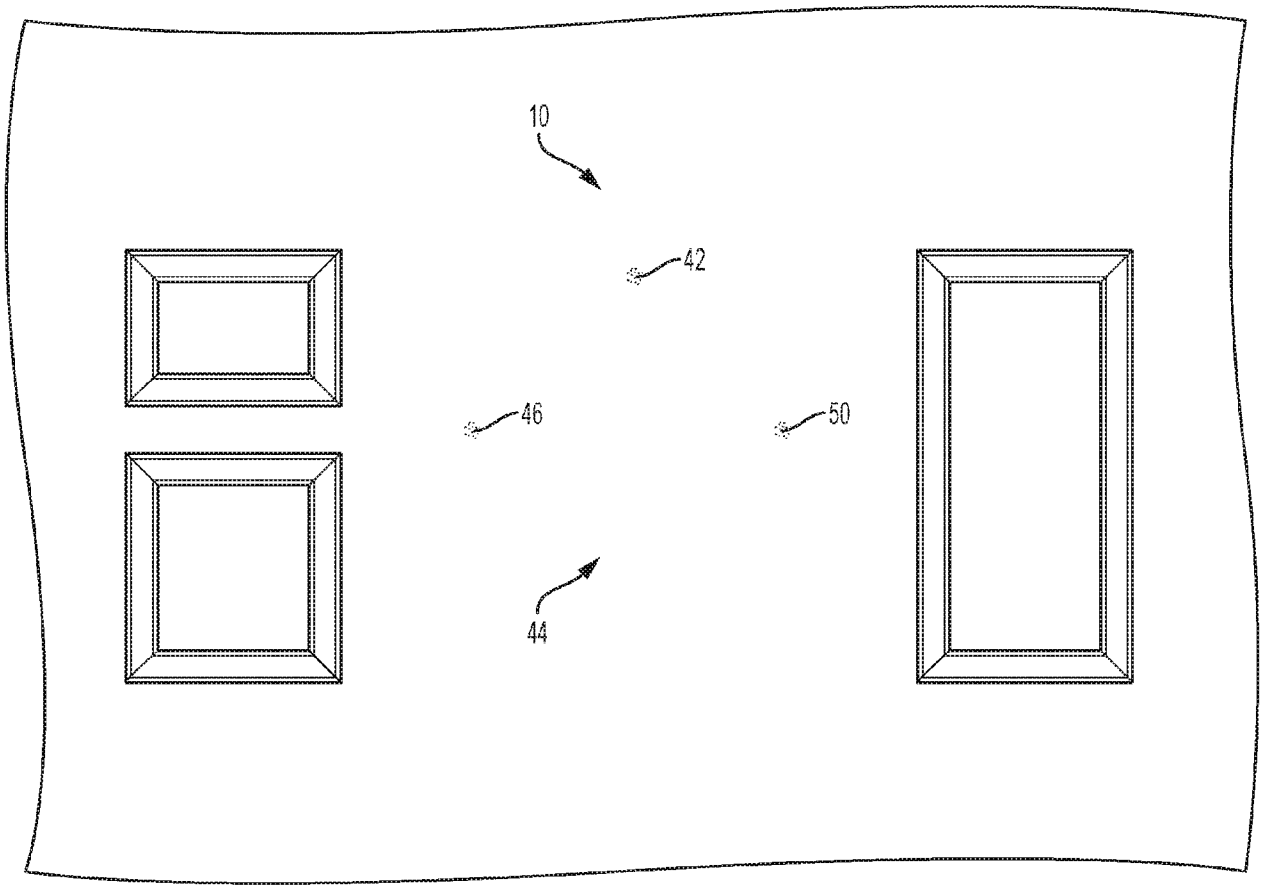
FIG. 5 shows a perspective view of one embodiment of the present invention.

Turning to FIG. 4, at step 40, pressing frame 12 into wall 42. In FIG. 5, at step 44, removing frame 12 and revealing first nail marker 46, second nail marker 48 and third nail marker 50.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A process for marking a wall in order to hang a frame on the wall; the process comprising:

obtaining a frame further comprising a first hanger position, a second hanger position, and a third hanger position;

applying an ink onto a sponge proximate the frame;

applying a first inked sponge over the first hanger position;

applying a second inked sponge over the second hanger position;

applying a third inked sponge over the third hanger position;

pressing the frame into the wall removing the frame from the wall revealing a first nail marker, s second nail marker and a third nail marker.

2. The process of claim 1, wherein the sponge further comprises a latex made of styrene and butadiene obtained from petroleum.

3. The process of claim 2, the ink consists essentially of:

water of about 5% of the ink by weight;

polysorbate 80 of about 75% of the ink by weight;

antioxidant 1076 of about 5% of the ink by weight; and pigment red 112 of about 15% of the ink by weight.

4. The process of claim 3 wherein the sponge and ink combination is about 60% sponge and 40% ink by weight.

* * * * *